US005979433A

United States Patent [19]

O'Brien

[11] Patent Number: 5,979,433

[45] Date of Patent: Nov. 9, 1999

[54] HEATER

[75] Inventor: Timothy Frank O'Brien, Braeside, Australia

[73] Assignee: Brivis Australia Pty Ltd., Victoria, Australia

[21] Appl. No.: 08/449,426

[22] Filed: May 24, 1995

[30] Foreign Application Priority Data

Feb. 16, 1995 [AU] Australia ..... PN1166

[51] Int. Cl.[6] ..... F24H 3/02

[52] U.S. Cl. ..... 126/116 R; 126/110 R; 126/99 R

[58] Field of Search ..... 126/110 R, 110 A, 126/110 B, 110 D, 116 R, 99 R; 165/176

[56] References Cited

U.S. PATENT DOCUMENTS

| | | | |
|---|---|---|---|
| 1,842,701 | 1/1932 | Vedrinsky . | |
| 2,582,066 | 1/1952 | Resek | 126/110 B |
| 3,563,212 | 2/1971 | Hoagland | 122/367.1 |
| 4,751,910 | 6/1988 | Allen et al. | 126/117 |
| 5,097,819 | 3/1992 | Talbert et al. | 126/99 R |
| 5,165,386 | 11/1992 | Van Der Veen | 126/116 R |

FOREIGN PATENT DOCUMENTS 0210262 11/1984 Japan .

*Primary Examiner*—Carl D. Price
*Attorney, Agent, or Firm*—Ryan, Maki, Mann & Hohenfeldt

[57] ABSTRACT

A heater for heating a stream of air has a burner assembly to heat the stream as it flows along a flow path and a primary heat assembly positioned in the flow path and coupled to the burner assembly for conducting gaseous combustion products. The primary heat exchange assembly has an array of U-shaped heat exchange tubes for conducting hot combustion products generated by the burner assembly to an array of second U-shaped heat exchange tubes for combustion products discharged from the first heat exchange tubes, the second tube having a smaller diameter than the first and being positioned in the space defined by the array of first U-shaped heat exchange tubes. Combustion products leaving the primary heat exchange assembly are passed through a secondary heat exchange assembly before being exhausted.

17 Claims, 4 Drawing Sheets

HEATER

BACKGROUND OF THE INVENTION

The present invention relates to heaters generally and in particular to a heater of the type which heats a stream of air flowing through the heater by heat exchange between the air and heat generated by a burner assembly.

Although by no means exclusively, the present invention relates to a heater for use as a part of a ducted space heating system for a domestic home.

SUMMARY OF THE INVENTION

An object of the present invention is to provide a domestic space heater that alleviates disadvantages of conventional space heaters.

According to the invention disclosed herein there is provided a heater for heating a stream of air, the heater comprising:

(a) a flow path for the stream of air;

(b) a burner assembly to heat the air as the stream of air flows along the flow path; and (c) a primary heat exchange assembly positioned in the flow path and coupled to the burner assembly, the primary heat exchange assembly comprising:

(i) an array of first heat exchange tubes for combustion products generated by the burner assembly, each first heat exchange tube having a U-shaped section; and (ii) an array of second heat exchange tubes for combustion products discharged from the first heat exchange tubes, the second heat exchange tubes having a smaller diameter than that of the first heat exchange tubes and being positioned in the space defined by the U-shaped sections of the array of first heat exchange tubes.

It can readily be appreciated that such an arrangement provides in a compact space a substantial surface area for heat exchange between the combustion products flowing through the first and second heat exchange tubes and the air stream flowing along the flow path.

It is preferred that the U-shaped sections of the first heat exchange tubes be parallel.

It is preferred that the primary heat exchange assembly comprises a manifold connected to outlet ends of the first heat exchange tubes and inlet ends of the second heat exchange tubes for distributing combustion products from the first heat exchange tubes to the smaller diameter second heat exchange tubes.

It is preferred that the heater further comprises a secondary heat exchange assembly for receiving combustion products discharged from the primary heat exchange assembly.

It is preferred particularly that the secondary heat exchange assembly be positioned in the flow path upstream of the primary heat exchange assembly in the direction of flow of air along the flow path.

It is preferred that the secondary heat exchange assembly comprises a manifold connected to outlet ends of the second heat exchange tubes and the inlet end of the secondary heat exchange assembly for distributing combustion products from the second heat exchange tubes to the secondary heat exchange assembly.

It is preferred that the burner assembly be gas-fired.

It is preferred particularly that the burner assembly be a forced air gas-fired burner assembly.

It is preferred that the heater include a means for preheating combustion air for the burner assembly.

It is preferred particularly that the preheating means comprises a passage or chamber for supplying combustion air to the burner assembly that is positioned proximate one or more of:

(a) the flow path for the stream of air to be heated;

(b) the primary heat exchange assembly; and (c) the secondary heat exchange assembly;

so that combustion air for the burner assembly is preheated as it flows through the passage or chamber to the burner assembly by heat exchange with one or more of the air stream in the flow path and the combustion products flowing through the primary and the secondary heat exchange assemblies.

It is preferred that the heater further comprises an electronics/controller assembly.

It is preferred particularly that the preheating means separates the electronics/controller assembly and one or more of the flow path of the air to be heated, the primary heat exchange assembly, and the secondary heat exchange assembly.

With such an arrangement, it can readily be appreciated that the preheating means acts as a thermal insulation for the components in the electronics/controller assembly.

It is preferred that the heater further comprises a housing comprising a base wall, side walls, end walls, and a removable lid.

It is preferred that the side walls and/or the end walls comprise an inlet for the stream of air to be heated and an outlet for the stream of heated air.

It is preferred that the heater further comprises a chassis which supports the burner assembly, the primary heat exchange assembly, the secondary heat exchange assembly, and the electronics/controller assembly.

It is preferred that the chassis comprises a means for engaging the upper section of the side walls and/or the end walls of the housing for locating the chassis in relation to the housing.

It is preferred that the heater further comprises a fan assembly for forcing air to be heated along the flow path.

It is preferred that the heater further comprises a combustion air fan assembly for forcing combustion air along the passage to the burner assembly.

It is preferred that the chassis supports one or both of the fan assemblies.

According to the invention there is also provided a heater for heating a stream of air, the heater comprising:

(a) a flow path for the stream of air;

(b) a gas-fired burner assembly to heat the air as the stream of air flows along the flow path;

(c) a primary heat exchange assembly positioned in the flow path and coupled to the burner assembly; and (d) a means for preheating combustion air for the burner assembly.

It is preferred that the preheating means comprises a passage or chamber for supplying combustion air to the burner assembly that is positioned proximate one or more of:

(a) the flow path for the stream of air to be heated;

(b) the primary heat exchange assembly; and (c) the secondary heat exchange assembly;

so that the combustion air for the burner assembly is preheated as it flows along the passage or chamber to the burner assembly by heat exchange with one or more of the air stream in the flow path and the combustion products in the primary and the secondary heat exchange assemblies.

According to the present invention there is provided a heater for heating a stream of air passing through the heater along a flow path, the heater comprising:

(a) a burner assembly to heat the air by heat exchange between the air and the combustion products;

(b) a primary heat exchange assembly coupled to the burner assembly for defining a flow path that brings the combustion products into heat exchange relationship with the air to be heated;

(c) a housing for the burner assembly and the primary heat exchange assembly, the housing comprising a base wall, side walls, and end walls, the side walls and/or the end walls comprising an inlet for the air to be heated and an outlet for heated air, and the space between the inlet and the outlet defining the flow path for the air to be heated; and (d) a chassis supporting the burner assembly and the primary heat exchange assembly, the chassis comprising a means for engaging the upper section of the side walls and/or the end walls of the housing for locating the chassis in relation to the housing.

The present invention is described further by way of example with reference to the accompanying drawings, in which:

DESCRIPTION OF A PREFERRED EMBODIMENT

The heater shown in the figures is suited particularly, although by no means exclusively, for use as part of a ducted space heating system for a domestic home. In such a space heating system, typically, the heater is operated to heat a stream of air which is drawn via a return air duct in the home or from outside the home and the heated air is distributed through the home via a duct network.

Figure 1:
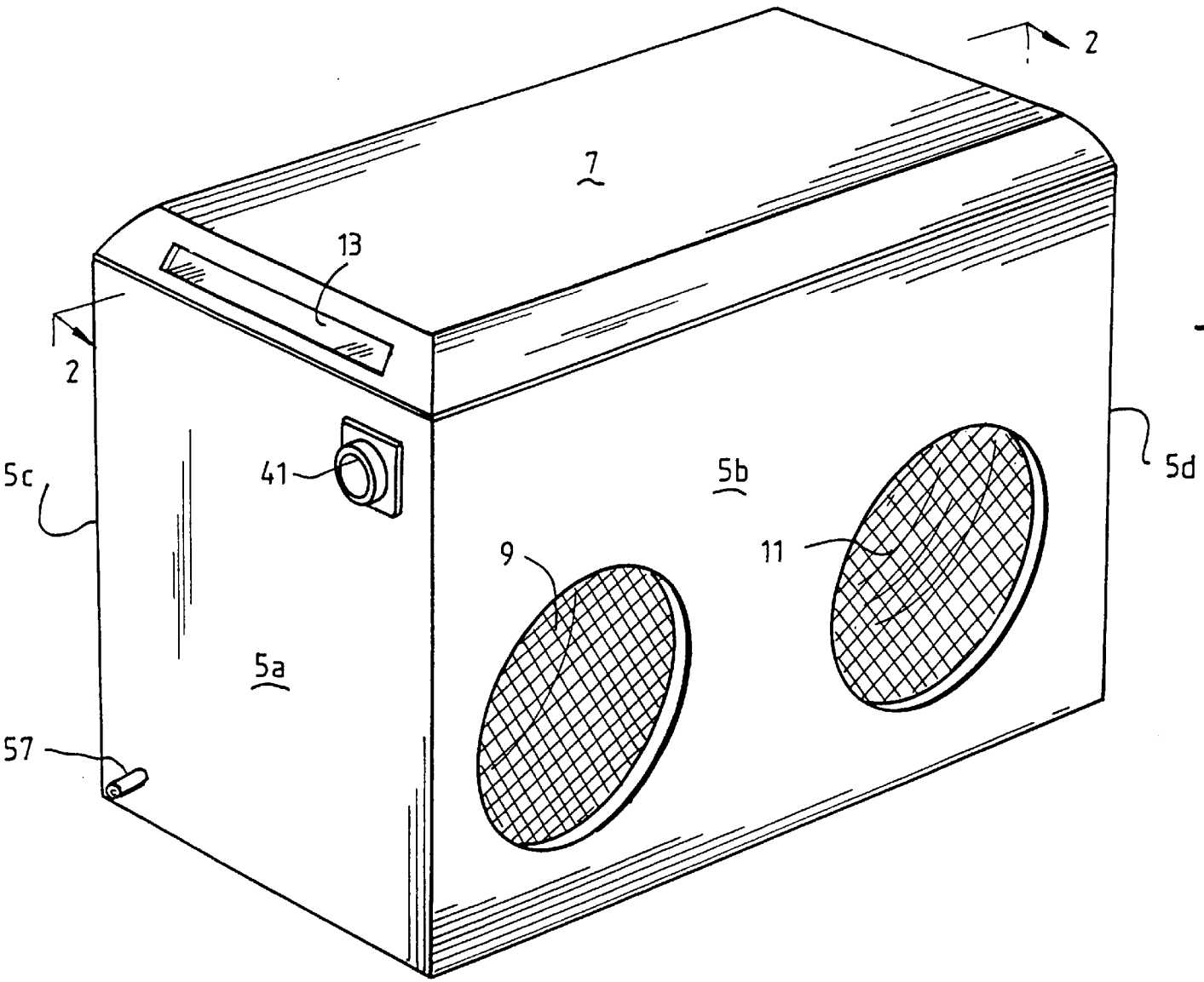
FIG. 1 is a perspective view of a preferred embodiment of a heater in accordance with the present invention.
Figure 2:
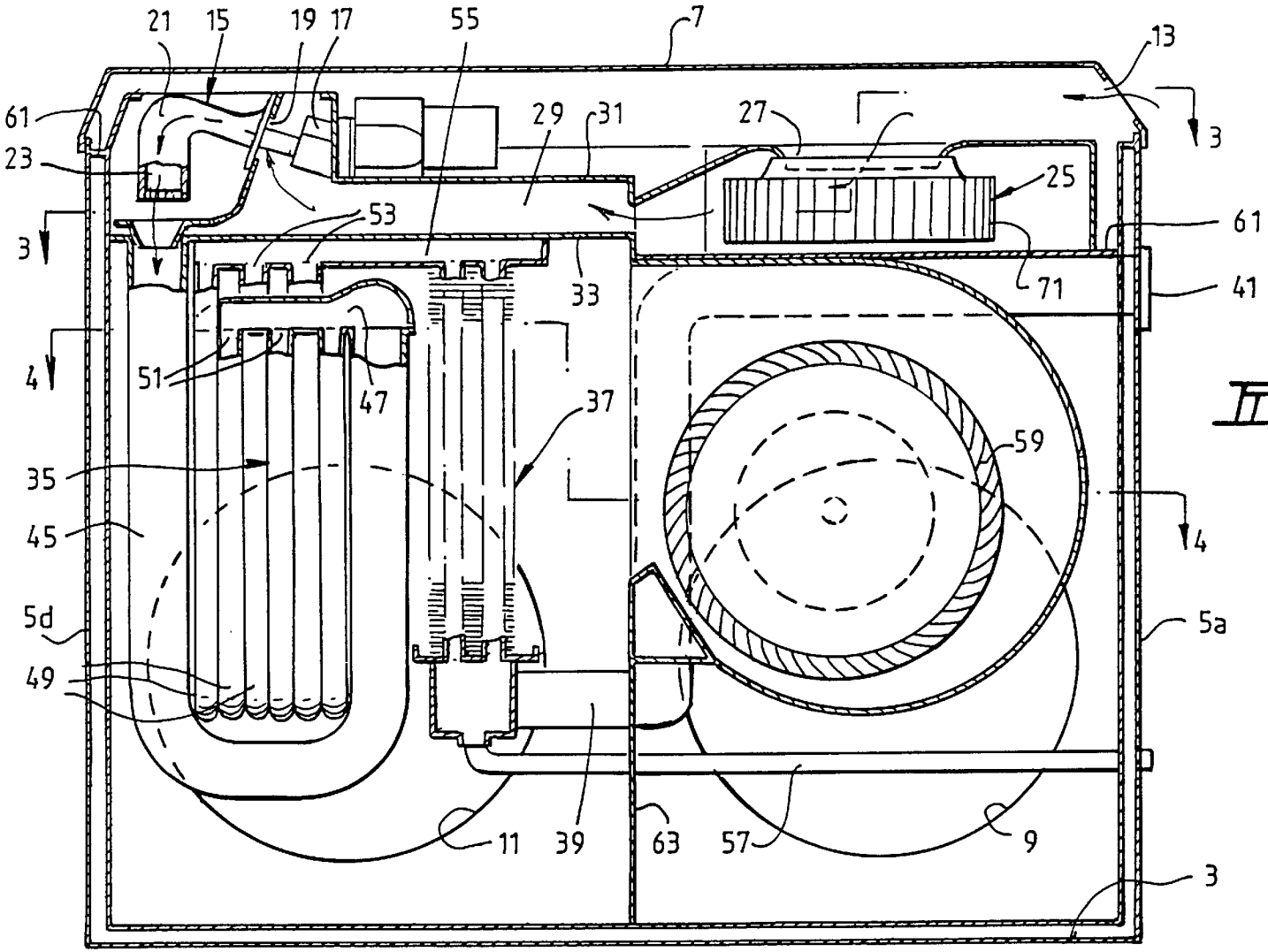
FIG. 2 is a vertical section through the heater along the line 2—2 in FIG. 1.
Figure 3:
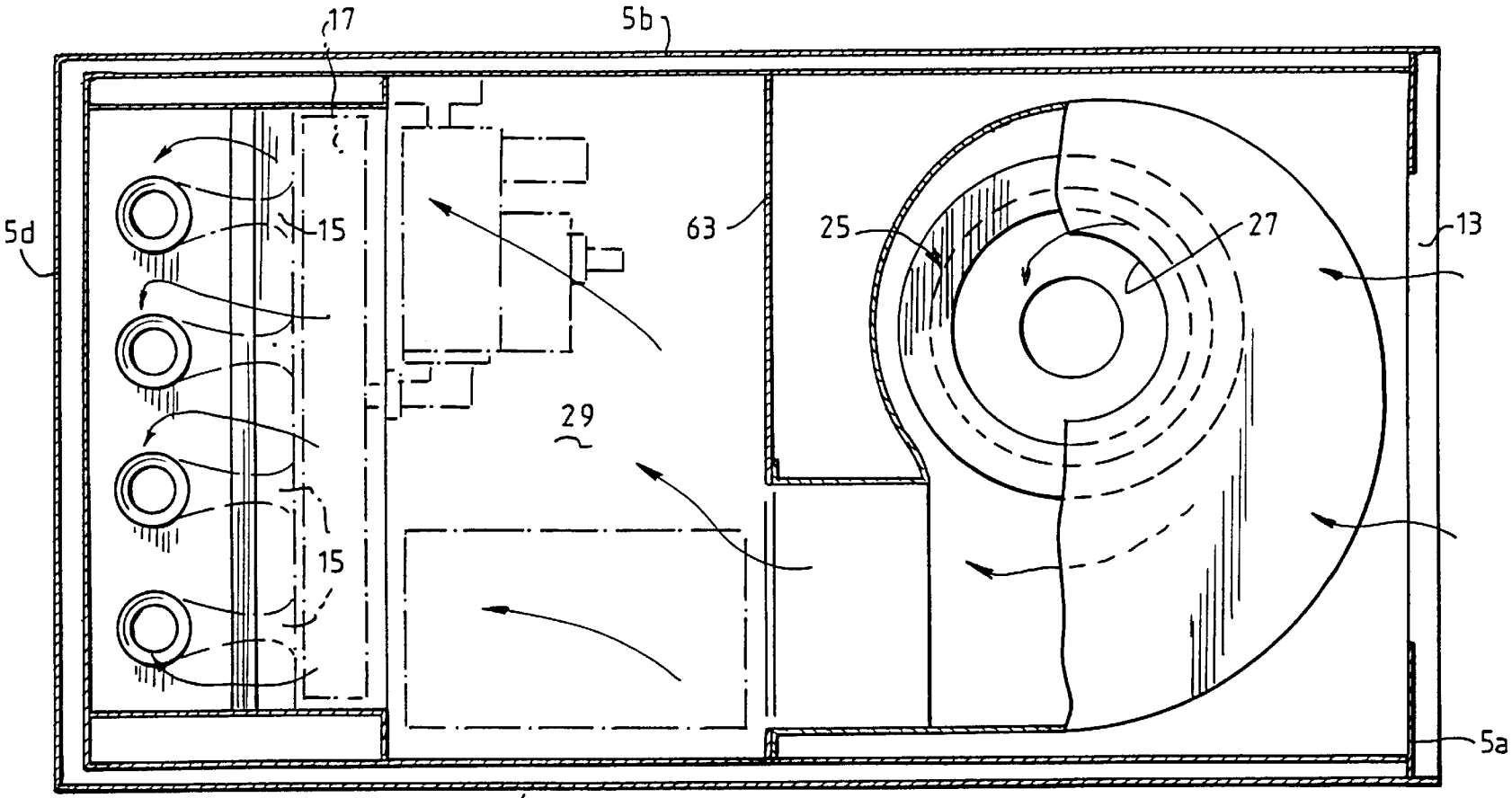
FIG. 3 is a horizontal section through the heater along the line 3—3 in FIG. 2.

With reference to FIGS. 1 and 2 the heater comprises a housing having a base wall 3, parallel side walls 5*b*, 5*c*, parallel end walls 5*a*, 5*d*, and a removable lid 7. The housing, as with the other components of the heater, may be formed from any suitable materials.

The housing comprises an inlet 9 for a stream of air to be heated and an outlet 11 for heated air.

In the particular embodiment shown in figures the inlet 9 and the outlet 11 are located in the same side wall 5*b*. In alternative embodiments of the invention the inlet 9 and the outlet 11 are formed in different side walls and/or the end walls to suit particular locations for the heater in a home.

With further reference to FIGS. 1 and 2, the detachable lid 7 includes a combustion air inlet 13 formed at one end of the lid 7.

The heater is arranged to heat a stream of air that flows between the inlet 9 and the outlet 11 by heat exchange between the air and heat generated by a gas-fired burner assembly.

With reference to FIGS. 1 and 2, the burner assembly comprises 4 burners 15 that are arranged in a line across an upper section proximate one of the shorter ends of the heater. As can best be seen in FIG. 2, each burner 15 includes a combustion gas injector 17 for injecting combustion gas, such as natural gas, into an inlet 19 of a burner chamber 21 which is formed with a generally right angle bend so that combustion products are discharged in a downward direction from the outlet 23 of the burner chamber 21.

A stream of combustion air is also introduced as a forced-air stream into the inlet 19 of the burner chamber 21. The combustion air is forced to the burners 15 through a chamber 29 from the combustion air inlet 13 in the lid 7 by means of a rotary fan 25 which is positioned in an upper section of the heater proximate the combustion air inlet 13. The fan 25 has a central inlet 27 and an assembly of radial vanes 71 that, on rotation about a vertical axis, force the combustion air into the chamber 29.

The chamber 29 extends substantially across the upper section of the heater and is defined by an upper wall 31 and a lower wall 33 and a series of side walls (not shown). This structure, and a vertical central plate 63, (FIG. 2) form the major framework of a chassis which supports the components of the heater. In this connection, the framework includes a peripheral flange 61 (FIG. 2) which, in use, rests on the upper edges of the side walls 5*b*, 5*c* and the end walls 5*a*, 5*d* of the housing.

With reference to FIG. 2, the lower wall 33 separates upper and lower sections of the heater. The upper section of the heater houses the electronics and control components (not shown) of the heater. In this connection, the upper wall 31 forms a base for the electronics and control components of the heater. The lower section of the heater houses heat exchange components of the heater, as described hereinafter, and defines the flow path for air to be heated between the inlet 9 and the outlet 11 in the housing.

In particular, it is noted that the combustion air chamber 29 serves the function of forming a thermal insulation for the electronics/control components of the heater. Specifically, the combustion air that flows through the chamber 29 is preheated by heat exchange with heat conducted through the lower wall 33 and thereby removes heat that otherwise would heat and thereby potentially damage the electronics/control components.

The combustion products discharged from the outlets 23 of the burners 15 of the burner assembly flow through a primary heat exchange assembly (generally identified by the numeral 35), a secondary heat exchange assembly (generally identified by the numeral 37), and finally a combustion products flue duct 39 which discharges the now-cooler combustion products through the outlet 41 in the end wall 5*a* of the housing.

The secondary heat exchange assembly 37 is located upstream of the primary heat exchange assembly in the direction of the flow of air to be heated from the air inlet 9 to the outlet 11 in the housing. In use of the heater, the secondary heat exchange assembly 37 pre-heats the air to be heated to an initial temperature $T_1$ and the primary heat exchange assembly 35 heats the air further to a higher temperature $T_2$.

The primary heat exchange assembly 35 includes 4 parallel relatively large diameter U-shaped heat exchange tubes 45 which are arranged with the inlet end of each tube 45 being connected to the outlet 23 of a respective one of the 4 burners 15.

The combustion products from the burners 15 flow through the U-shaped tubes 45 into 2 manifolds 47 and from the manifolds into 12 smaller diameter U-shaped heat exchange tubes 49.

Figure 4:
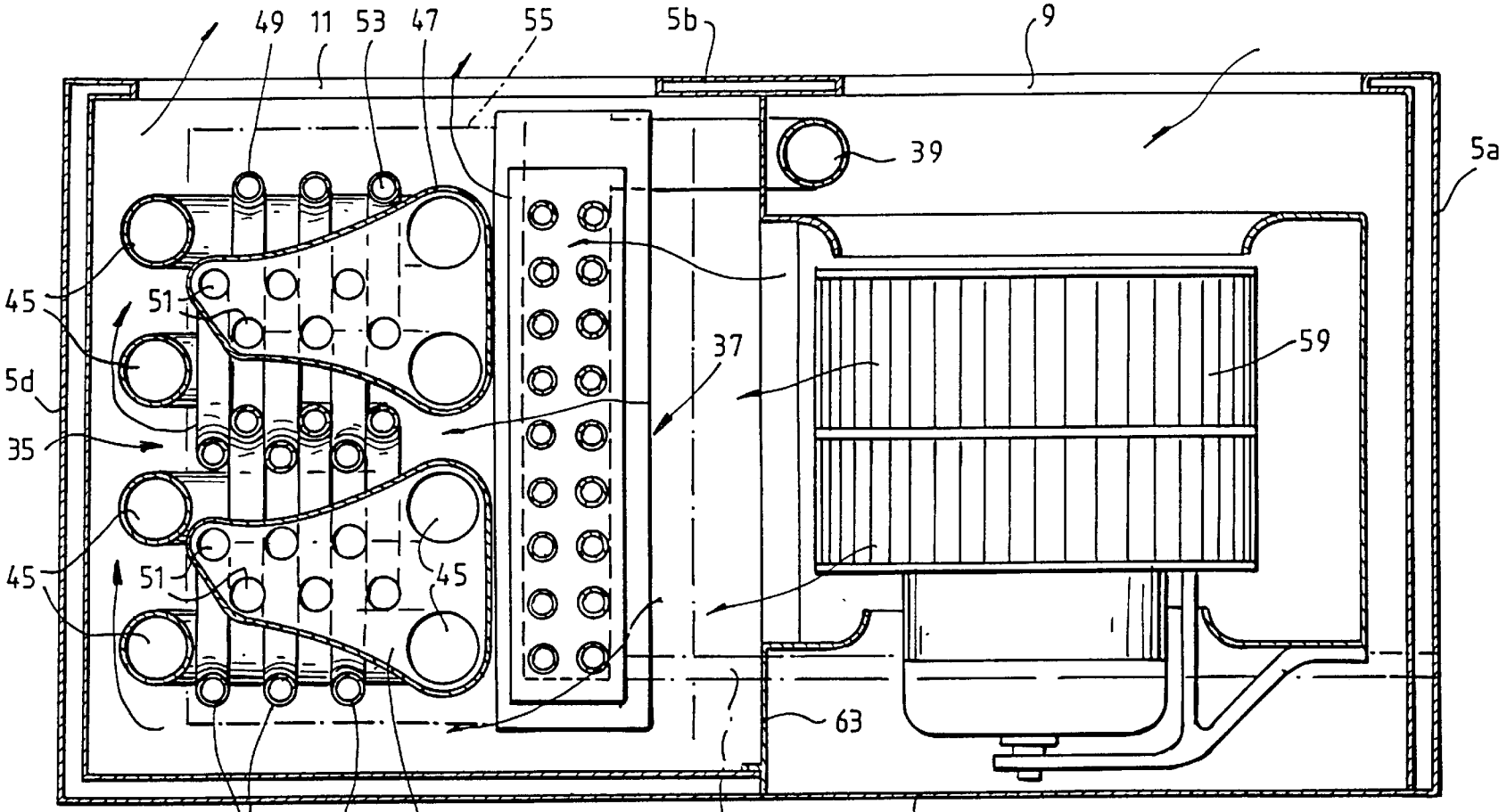
FIG. 4 is a horizontal section through the heater along the line 4—4 in FIG. 2.

With reference to FIGS. 2 and 4, the larger diameter tubes 45 are positioned so that the arms of the U-shaped tubes are vertical and the tubes 45 extend parallel to the side walls 5*b*, 5*c* of the housing. The array of the U-shaped tubes 45 and the manifolds 47 define a space, and the smaller diameter U-shaped tubes 49 are positioned to occupy that space. In this connection, the tubes 49 are positioned so that the arms of the U-shaped tubes are vertical and the tubes 49 extend parallel to the end walls 5*a*, 5*d* of the housing.

With further reference to FIGS. 2 and 4, the smaller diameter tubes 49 are arranged so that the inlet end 51 of one arm of each U-shaped tube 49 is connected to one of the manifolds 47 and the outlet end 53 of the other arm of the tube 49 is connected to a secondary heat exchanger manifold 55 which distributes the combustion products to the inlet end of the tube and fin secondary heat exchanger 37. In use, the combustion products flow downwardly through the tubes of the secondary heat exchanger 37 and thereafter through the combustion products flue duct 39 to the outlet 41.

The secondary heat exchange assembly 37 includes a drain line 57 in the lower section to remove condensate that is a product of combustion and which would otherwise build-up affect operation of the secondary heat exchange assembly 37.

The heater further comprises a main fan 59 which draws air to be heated through the inlet 9 in the housing and forces the air to the outlet 11 in the housing.

The heater described above has a number of important features, and the following is a summary of some of these features.

1. The arrangement of the larger diameter heat exchange tubes 45 and the smaller diameter heat exchange tubes 49 is compact but nevertheless provides a substantial heat exchange surface area and, in the final analysis, allows the overall size of the heater to be relatively small compared to that of conventional heaters of comparable performance.
2. The combustion air chamber 29 thermally insulates the electronics/control components of the heater and makes it possible to minimise/avoid the use of thermal insulation materials.
3. The combustion air chamber 29 enables the combustion air to be preheated and this improves the operation of the burner assembly.
4. The mounting of the main components of the heater to the chassis makes it possible to use one configuration of the components for a number of different inlet/outlet configurations in the housing.

Many modifications may be made to the preferred embodiment of the heater described with reference to FIGS. 1 to 4 without departing from the spirit and scope of the present invention.

By way of example, whilst the preferred embodiment includes 4 burners 15, it can readily be appreciated that the present invention is not restricted to this number of burners 15 and any suitable number of burners 15 may be used.

In addition, whilst the preferred embodiment includes a primary heat exchange assembly 35 with 4 U-shaped heat exchange tubes 45, 2 manifolds 47, and 12 smaller diameter U-shaped heat exchange tubes 49, it can readily be appreciated that the present invention is not restricted to stated numbers of tubes 47, 49 and manifolds 47 and any suitable number of such components may be used to construct the primary heat exchange assembly 35.

I claim:

1. A heater for heating a stream of air, the heater comprising:

(a) a housing and members in the housing defining a flow path for the stream of air to be heated;

(b) a burner assembly for producing combustion products; and (c) a primary heat exchange assembly positioned in the flow path and comprising:

(i) an array of first heat exchange tubes having inlets coupled to the burner assembly for conducting combustion products generated by the burner assembly and having outlets, each first heat exchange tube having U-shaped sections that define a space between them; and (ii) an array of second U-shaped heat exchange tubes for conducting combustion products discharged from the first heat exchange tubes, said second heat exchange tubes having inlets for communicating with the first heat exchange tubes and having outlets, the second heat exchange tubes, respectively, having a diameter that is smaller than the diameter of the first heat exchange tubes and being positioned in said space defined by said sections of the array of said first heat exchange tubes.

2. A heater according to claim 1 wherein said sections of the first heat exchange tubes are parallel.

3. A heater according to any one of claims 1 or 2 wherein the primary heat exchange assembly further comprises a manifold connected to said outlets of the first heat exchange tubes and said inlets of the second heat exchange tubes for distributing combustion products from the first heat exchange tubes to the smaller diameter second heat exchange tubes.

4. A heater according to claim 3 further comprises a secondary heat exchange assembly having inlet and outlet means, the inlet means being in communication with said outlets of said second heat exchange tubes for receiving combustion products discharged from the primary heat exchange assembly.

5. A heater according to claim 4 wherein the secondary heat exchange assembly is positioned in the flow path upstream of the primary heat exchange assembly in the direction of flow of air along the flow path.

6. A heater according to claim 5 wherein the secondary heat exchange assembly comprises a manifold connected to said outlets of the second heat exchange tubes and said inlet means of the secondary heat exchange assembly connect to said manifold for distributing combustion products from the second heat exchange tubes to the secondary heat exchange assembly.

7. A heater according to claim 1 wherein the burner assembly is gas-fired.

8. A heater according to claim 7 wherein the burner assembly is a forced air gas-fired burner assembly.

9. A heater according to claim 7 further comprising a means for preheating combustion air for the burner assembly.

10. A heater according to claim 9 wherein the means for preheating combustion air comprises a passageway for supplying combustion air to the burner assembly, said passageway being positioned proximate one or more of:

(a) said flow path for said stream of air to be heated;

(b) said primary heat exchange assembly; and (c) said secondary heat exchange assembly;

so that combustion air for the burner assembly is preheated as it flows through said passageway to the burner assembly by heat exchange with the air stream in the flow path and the combustion products flowing through the primary and the secondary heat exchange assemblies.

11. A heater according to claim 10 including within said housing a chamber for containing an electronic controller and said passageway through which said combustion air flows to be preheated is interposed between said chamber and one or more of the primary heat exchange assembly, and the secondary heat exchange assembly.

12. A heater according to claim 10 further comprises a chassis which supports the burner assembly, the primary heat exchange assembly, the secondary heat exchange assembly, and said chamber for containing an electronics/controller assembly.

13. A heater according to claim 12 wherein said chassis has a means for engaging the side walls and/or the end walls of the housing for positioning the chassis in relation to said housing.

14. A heater according to claim 1 wherein said housing comprises a base wall, side walls, end walls, and a removable lid.

15. A heater according to claim 14 wherein a wall of the housing has an inlet for the stream of air to be heated and the same wall or another wall has an outlet for the stream of heated air.

16. A heater according to claim 1 including a fan assembly in said housing for forcing air to be heated along said flow path.

17. A heater according to claim 16 further comprising a combustion air fan assembly in said housing for forcing combustion air to flow in said passageway to the burner assembly.

* * * * *